US012774605B2

(12) United States Patent
Stearns et al.

(10) Patent No.: US 12,774,605 B2
(45) Date of Patent: Oct. 27, 2026

(54) ICE RETENTION ASSEMBLY

(71) Applicant: Vermont Slate & Copper Services, Inc., Morrisville, VT (US)

(72) Inventors: Brian Stearns, Tucson, AZ (US); Kris Michaud, Morrisville, VT (US); Crystal Fletcher, Morrisville, VT (US)

(73) Assignee: Vermont Slate & Copper Services, Inc., Morrisville, VT (US)

( * ) Notice: Subject to any disclaimer, the term of this patent is extended or adjusted under 35 U.S.C. 154(b) by 17 days.

(21) Appl. No.: 18/308,596

(22) Filed: Apr. 27, 2023

(65) Prior Publication Data

US 2023/0349159 A1 Nov. 2, 2023

Related U.S. Application Data

(60) Provisional application No. 63/335,664, filed on Apr. 27, 2022.

(51) Int. Cl.
*E04D 13/10* (2006.01)

(52) U.S. Cl.
CPC ..... *E04D 13/10* (2013.01)

(58) Field of Classification Search
CPC ..... E04D 13/10
USPC ..... 52/24
See application file for complete search history.

(56) References Cited

U.S. PATENT DOCUMENTS

| | | | | |
|---|---|---|---|---|
| 10,612,242 | B1 * | 4/2020 | Cox, Jr. | E04D 13/10 |
| 10,767,684 | B1 * | 9/2020 | Meine | F16B 33/004 |
| 11,598,098 | B2 * | 3/2023 | Shadwell | F16M 13/02 |
| 2011/0247279 | A1 * | 10/2011 | Stearns | E04D 13/1407 248/237 |
| 2014/0318032 | A1 * | 10/2014 | McCarthy | E04D 13/10 52/24 |
| 2023/0160209 | A1 * | 5/2023 | Stearns | E04D 13/10 52/24 |

* cited by examiner

*Primary Examiner* — Beth A Aubrey
(74) *Attorney, Agent, or Firm* — Mark Williams, P.C.

(57) ABSTRACT

The present disclosure relates to ice retention assemblies for buildings. The ice retention assemblies may comprise a body, a seal and a fastener. The body may have a base portion and a top portion. The top portion may be removable from the base portion. The base portion may defining a channel that is configured to receive a fastener. The base portion may have a generally planar bottom surface. The base portion may also comprise a sealing recess that is shaped to receive a seal. The seal may be installable in the sealing recess of the base portion. A fastener may be installable through at least a portion of the base portion. The fastener may be configured to compress the base portion and the seal against a surface.

10 Claims, 7 Drawing Sheets

ICE RETENTION ASSEMBLY

CROSS REFERENCE TO RELATED APPLICATIONS

The present application claims priority to and the benefit of U.S. Provisional Patent Application No. 63/335,664, filed Apr. 27, 2022 and entitled Ice Retention Assembly, the entire contents of which are herein incorporated by reference for any purpose.

FIELD

The present disclosure relates to an ice retention system for building facades.

BACKGROUND

Snow and ice accumulate on building ledges. As environmental conditions change, the snow and ice can slide off of building ledges and facades and fall to the ground, creating hazards for pedestrians and property adjacent the buildings. As such, there is a need to retain snow and ice on building facades and allow it to melt away in a controlled fashion.

SUMMARY

In various embodiments, an ice retention assembly may comprise a body, a seal and a fastener. The body may have a base portion and a top portion. The top portion may be removable from the base portion. The base portion may defining a channel that is configured to receive a fastener. The base portion may have a generally planar bottom surface. The base portion may also comprise a sealing recess that is shaped to receive a seal. The seal may be installable in the sealing recess of the base portion. A fastener may be installable through at least a portion of the base portion. The fastener may be configured to compress the base portion and the seal against a surface.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the inventions, it should be understood that other embodiments may be realized and that logical, chemical, and mechanical changes may be made without departing from the spirit and scope of the inventions. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full and/or any other possible attachment option. Additionally, any reference to without contact (or similar phrases) may also include reduced contact or minimal contact.

In various embodiments, the ice retention assembly disclosed herein may be configured to retain snow and ice on a building façade allowing for sufficient environmental conditions to safely melt the snow and ice away from the building. In this regard the ice retention assemblies disclosed herein may prevent large pieces of snow and ice from falling off of building facades creating dangerous conditions for people and property near a building.

Figure 1A:
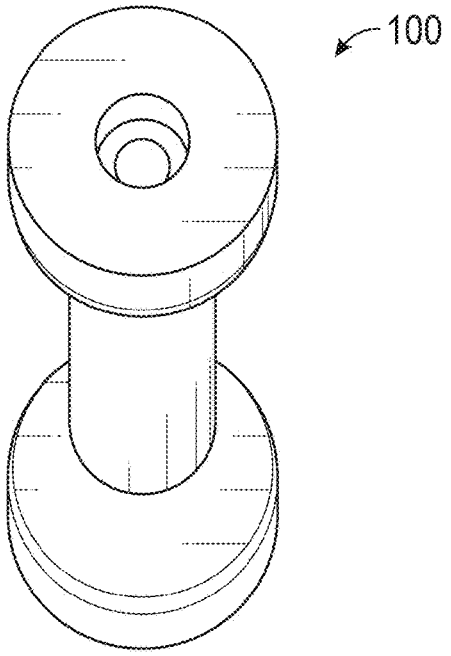
FIG. 1A illustrates a perspective view of an ice retention assembly having a first top, in accordance with various embodiments.
Figure 1B:
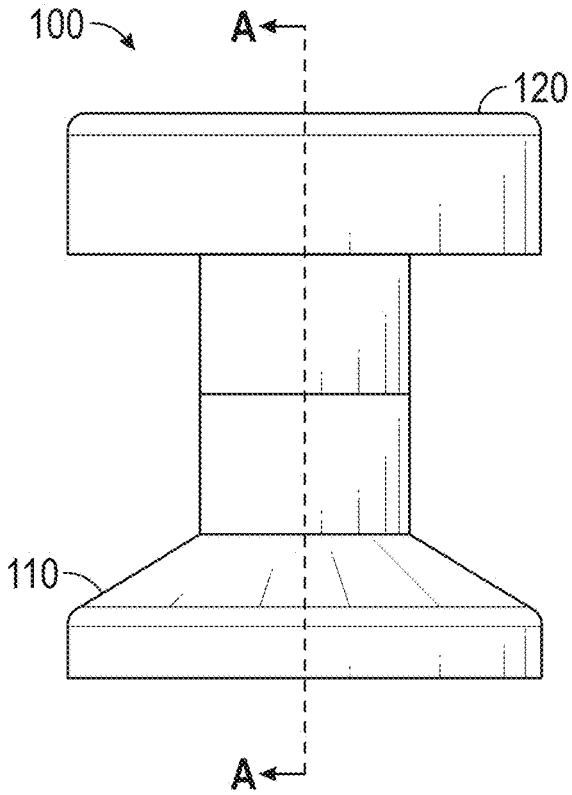
FIG. 1B illustrates a front view of an ice retention assembly having a first top, in accordance with various embodiments.
Figure 1C:
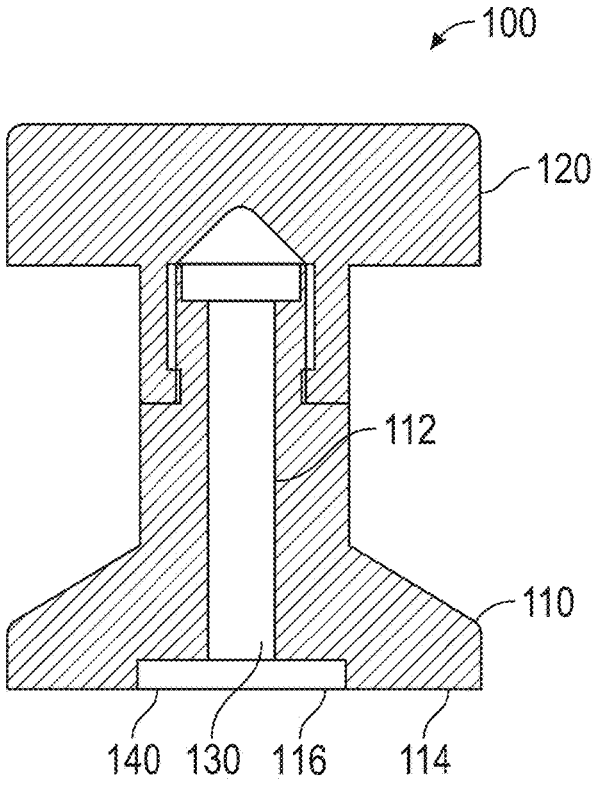
FIG. 1C illustrates a cross-sectional front view of an ice retention assembly having a first top, in accordance with various embodiments.

In various embodiments and with reference to FIG. 1A, FIG. 1B, and FIG. 1C, an ice retention assembly 100 is disclosed. Ice retention assembly 100 may comprise a body having a base portion 110 and a top portion 120. Top portion 120 may be removable from base portion 110. Base portion 110 may define a channel 112. Channel 112 may be sized and/or configured to receive a fastener 130. Base portion 110 may have a generally planar bottom surface 114. Base portion 110 may also comprise or define a sealing recess 116. Sealing recess 116 may be shaped to receive a seal 140. Seal 140 may be installable in sealing recess 116 of base portion 110.

In various embodiments, fastener 130 may be installable through at least a portion of base portion 110. Moreover, fastener 130 is configured to compress base portion 110 and seal 140 against a surface of a building. In this regard, any penetration of the surface by fastener 130 is watertight, preventing water damage to any internal structure of a building. Fastener 140 may be threaded. In this regard, fastener 140 may be threaded into base portion 110.

In various embodiments, channel 112 may be defined through base portion 110 and the top portion 120. In this regard, channel 112 may be concentrically aligned and defined in both base portion 110 and top portion 120. In various embodiments, ice retention assembly 100 may comprise a two-part washer that is configured to seal channel 112.

In various embodiments, top portion 120 may have a profile that is t-shaped in cross-section.

Figure 2A:
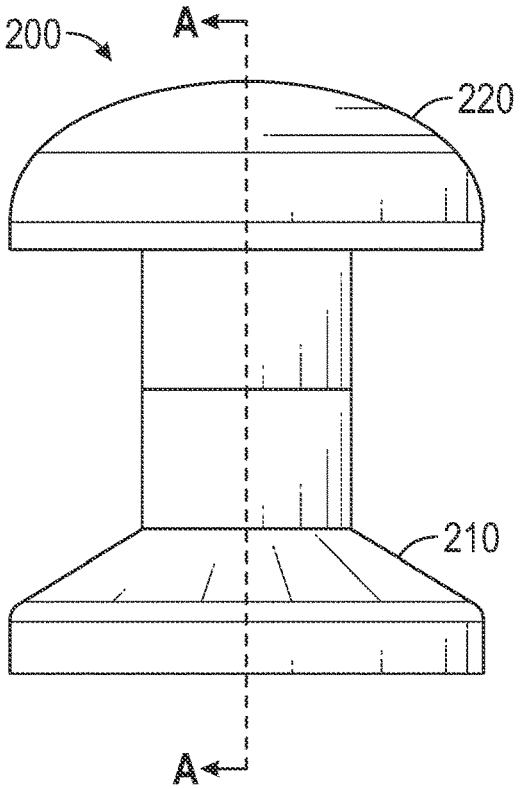
FIG. 2A illustrates a front view of an ice retention assembly having a second top, in accordance with various embodiments.
Figure 2B:
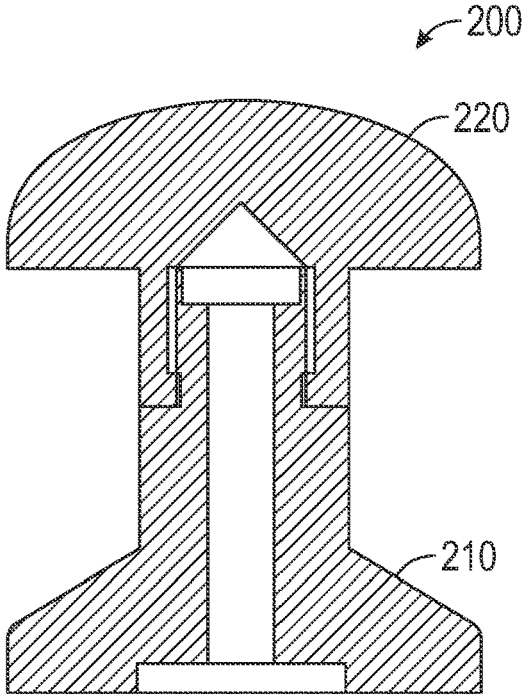
FIG. 2B illustrates a cross-sectional front view of an ice retention assembly having a second top, in accordance with various embodiments.

In various embodiments and with reference to FIG. 2A and FIG. 2B, ice retention assembly 200 may comprise a base portion 210 and a top portion 220. Top portion 220 may have a profile that is mushroom shaped, rounded or semi-circular in cross-section.

Figure 3A:
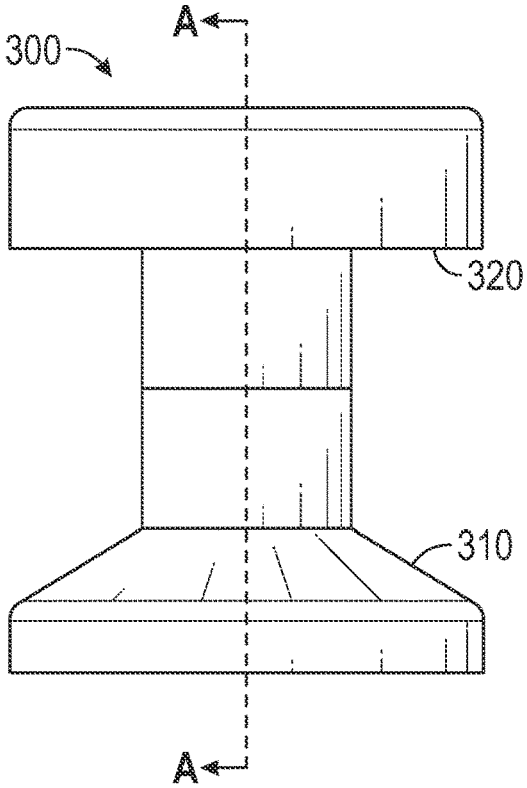
FIG. 3A illustrates a front view of an ice retention assembly having a third top, in accordance with various embodiments.
Figure 3B:
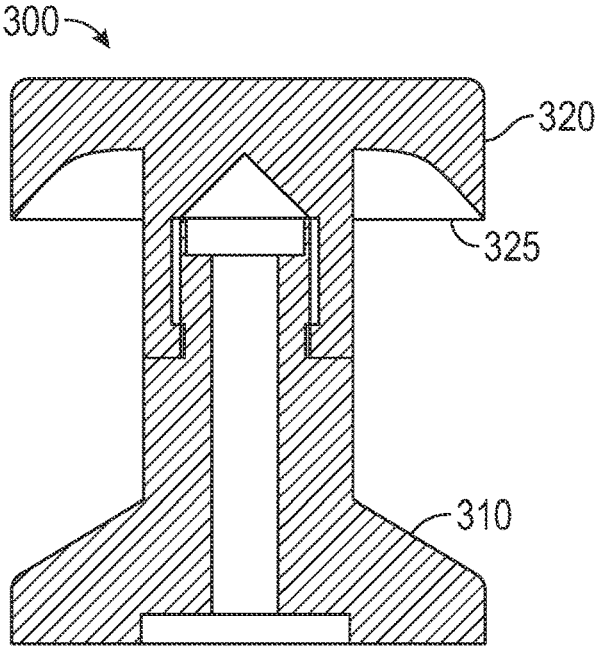
FIG. 3B illustrates a cross-sectional front view of an ice retention assembly having a third top, in accordance with various embodiments.

In various embodiments and with reference to FIG. 3A and FIG. 3B, ice retention assembly 300 may comprise a base portion 310 and a top portion 320. Top portion 320 may have an exterior profile that is t-shaped in cross section. Top portion 320 may also have an interior profile that includes recess 325. Recess 325 may increase the total surface area of ice retention assembly 300 or increase the friction between ice retention assembly 300 and the snow and/or ice on a building surface.

Figure 4A:
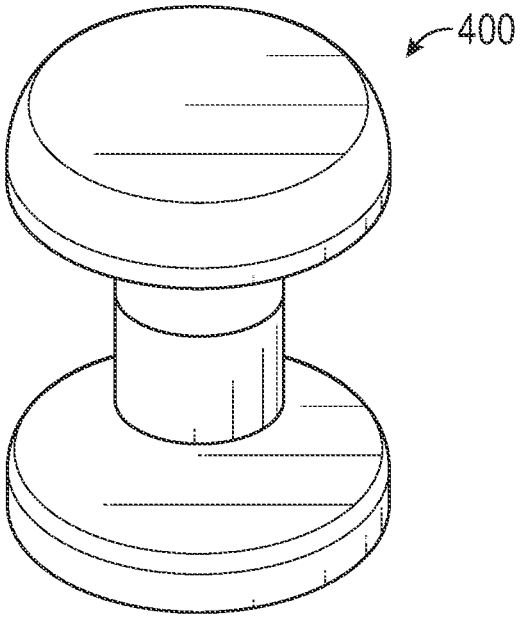
FIG. 4A illustrates a perspective view of an ice retention assembly having a fourth top, in accordance with various embodiments.
Figure 4B:
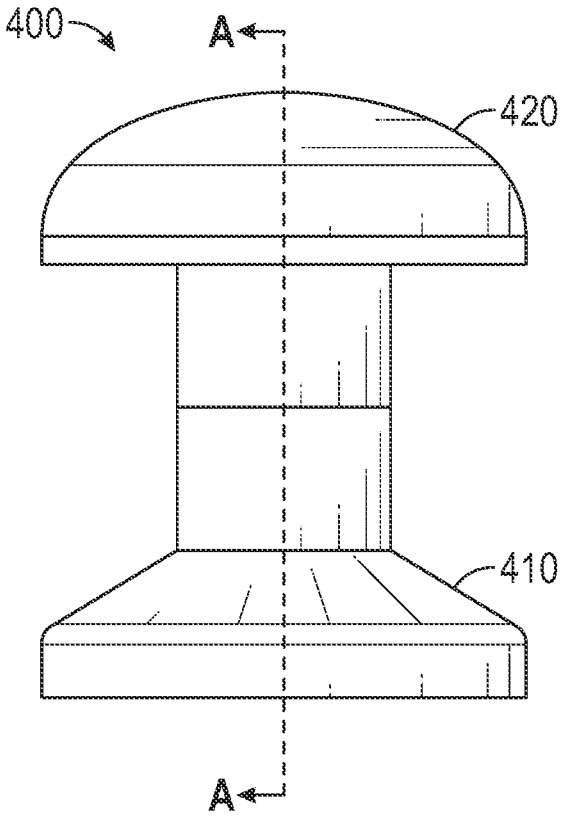
FIG. 4B illustrates a front view of an ice retention assembly having a fourth top, in accordance with various embodiments.
Figure 4C:
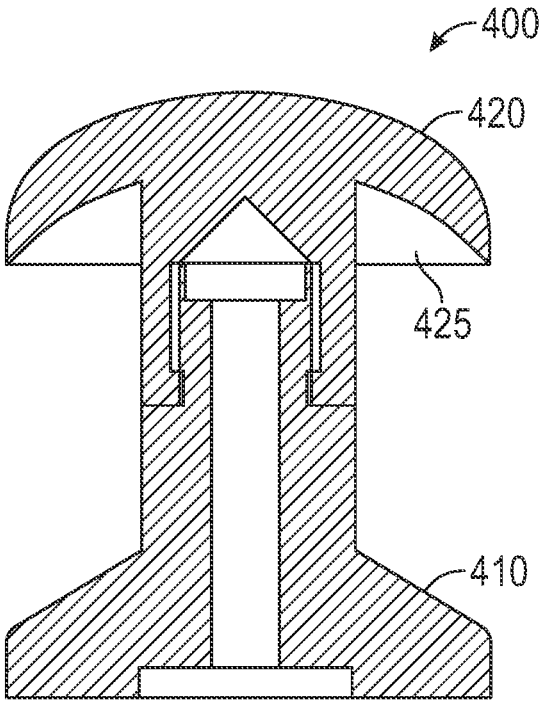
FIG. 4C illustrates a cross-sectional front view of an ice retention assembly having a fourth top, in accordance with various embodiments.
Figures 5A, 5B, 5C, 5D, 5E:
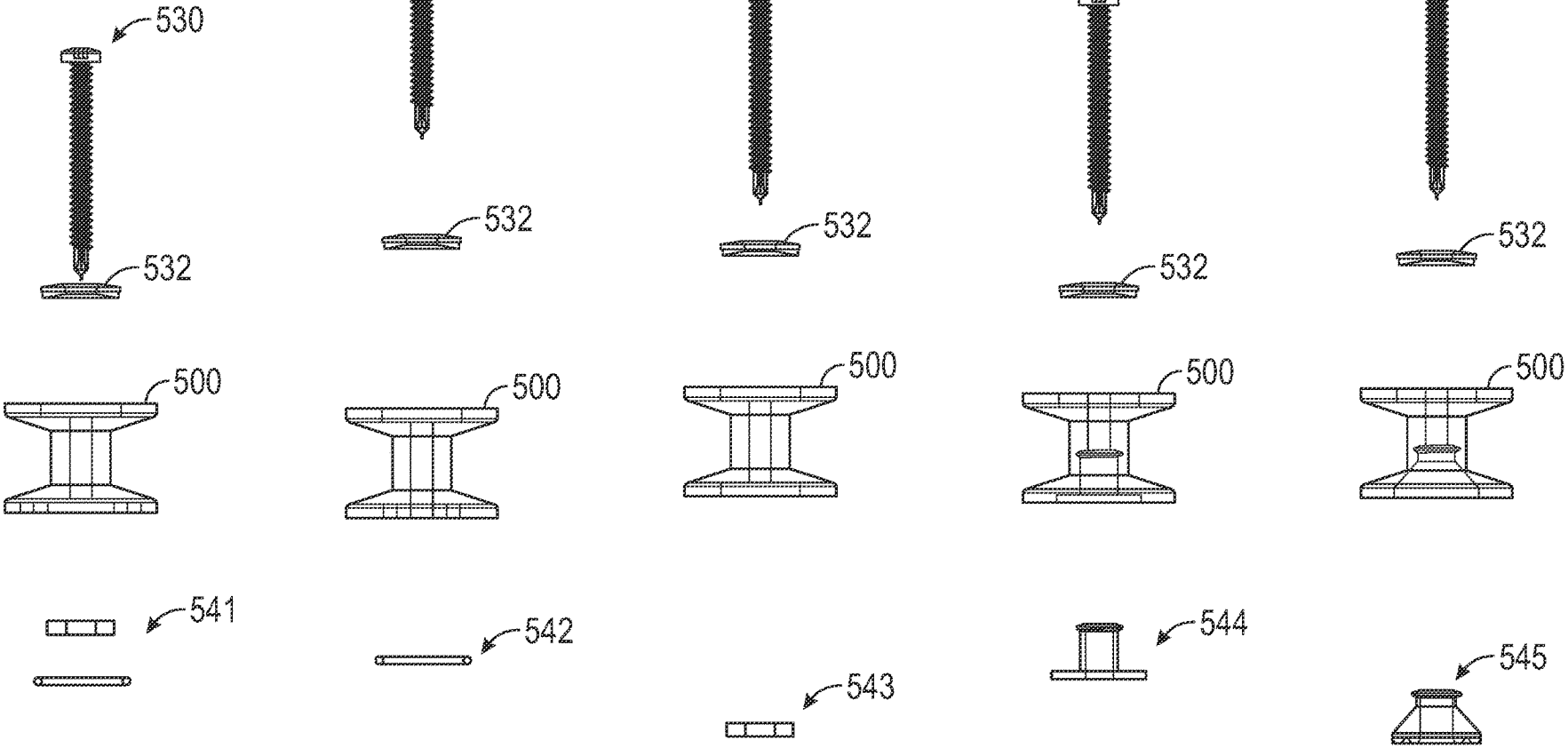
FIG. 5A illustrates an exploded view of an ice retention assembly having a first seal assembly, in accordance with various embodiments.
FIG. 5B illustrates an exploded view of an ice retention assembly having a second seal assembly, in accordance with various embodiments.
FIG. 5C illustrates an exploded view of an ice retention assembly having a third seal assembly, in accordance with various embodiments.
FIG. 5D illustrates an exploded view of an ice retention assembly having a fourth seal assembly, in accordance with various embodiments.
FIG. 5E illustrates an exploded view of an ice retention assembly having a fifth seal assembly, in accordance with various embodiments.

In various embodiments and with reference to FIG. 4A, FIG. 4B, and FIG. 4C, ice retention assembly 400 may comprise a base portion 410 and a top portion 420. Top portion 420 may have an exterior profile that is mushroom shaped, rounded, or semi-circular in cross-section. Top portion 420 may also have an interior profile that includes recess 425. Recess 425 may increase the total surface area of ice retention assembly 400 or increase the friction between ice retention assembly 400 and the snow and/or ice on a building surface.

In various embodiments and with reference to FIG. 5A, FIG. 5B, FIG. 5C, FIG. 5D, and FIG. 5E, ice retention assembly 500 may comprise one or more seals or seal assemblies. For example, a neoprene washer and round gasket may form seal assembly 541. Seal assembly 541 may be installable in ice retention assembly 500. Moreover, seal assembly 541 may be configured to seal a bottom surface penetration from fastener 530. Ice retention assembly may also include a two-piece washer or a bonded washer 532 that is installable with fastener 530. Washer 532 may be configured to seal a top surface of ice retention assembly 500. The seal user to seal the bottom fastener penetration may also be seal assembly 542 which may be a sound gasket. In another embodiment, seal assembly 543 may be a rubber washer. In yet another embodiment, seal assembly 544 may be a rubber bushing having a top hat or I-shaped profile in cross-section. In another embodiment, seal assembly 545 may be a tapered rubber bushing.

Figure 6A:
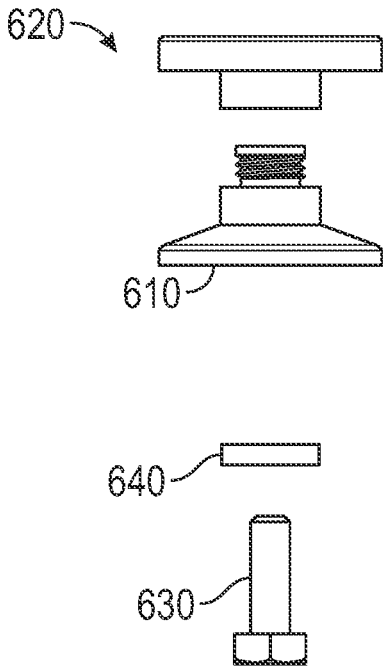
FIG. 6A illustrates an exploded view of an ice retention assembly having a bottom attachment system, in accordance with various embodiments.
Figure 6B:
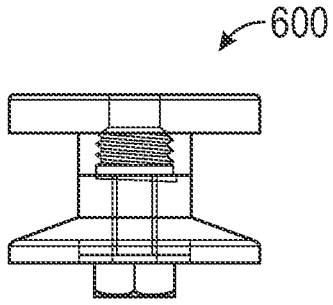
FIG. 6B illustrates a cross-sectional view of an ice retention assembly having a bottom attachment system, in accordance with various embodiments.

In various embodiments and with reference to FIG. 6A and FIG. 6B, ice retention assembly 600 may comprise a base portion 610 that is configured to receive a fastener 630 and/or seal 640 from and/or through the bottom of base portion 610. Top portion 620 may be configured to attach or otherwise thread on to base 610.

Figure 7A:
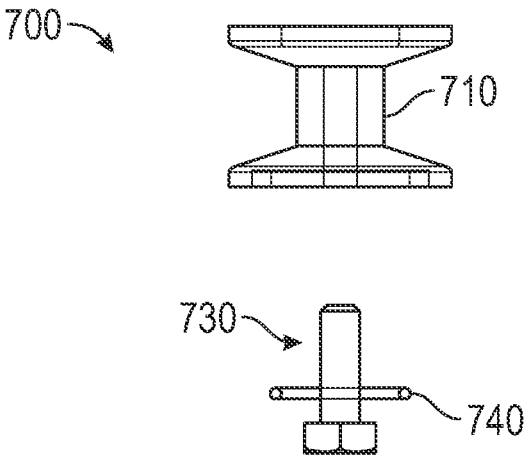
FIG. 7A illustrates an exploded view of a one-piece ice retention spool having a bottom attachment system, in accordance with various embodiments.
Figure 7B:
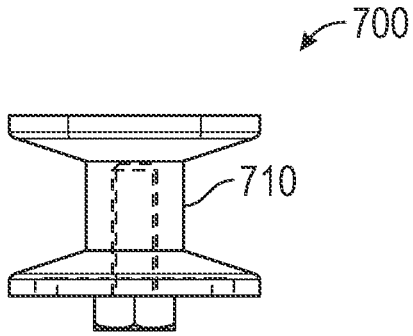
FIG. 7B illustrates a cross-sectional view of a one-piece ice retention spool having a bottom attachment system, in accordance with various embodiments.

In various embodiments and with reference to FIG. 7A and FIG. 7B, ice retention assembly 700 may comprise a once piece ice spool 710 that is configured to receive a fastener 730 and/or seal 740 from and/or through the bottom of ice spool 710.

Figure 8A:
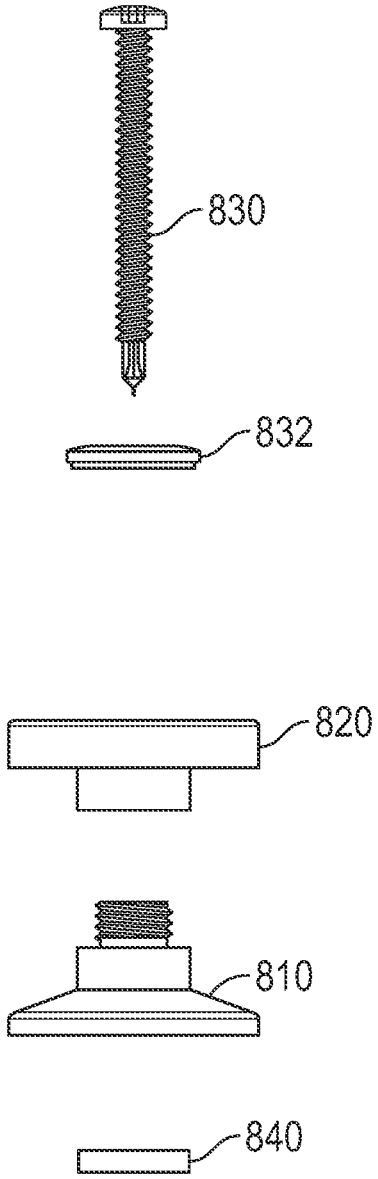
FIG. 8A illustrates an exploded view of an ice retention assembly having a top attachment system, in accordance with various embodiments.
Figure 8B:
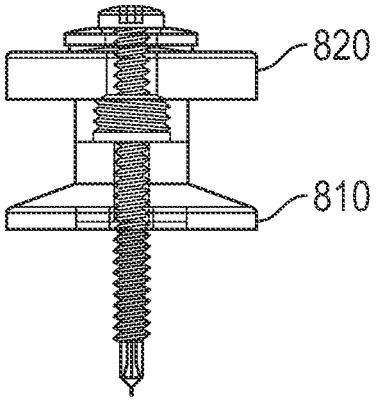
FIG. 8B illustrates a cross-sectional view of an ice retention assembly having a top attachment system, in accordance with various embodiments.

In various embodiments and with reference to FIG. 8A and FIG. 8B, ice retention assembly 800 may comprise a once piece ice spool 810 that is configured to receive seal 840 from and/or through the bottom of ice spool 810. Fastener 830 and bonded washer 832 may be installable on and/through ice spool 810 of ice retention assembly 800.

Figure 9A:
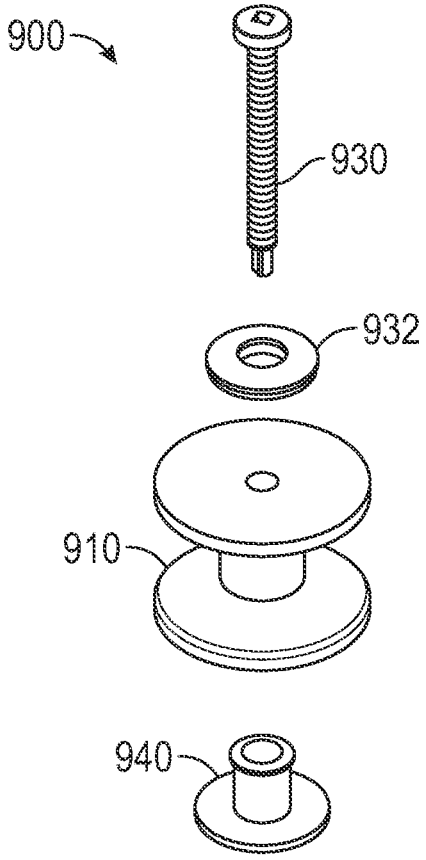
FIG. 9A illustrates an exploded view of a one-piece ice retention spool having a top attachment system, in accordance with various embodiments.
Figure 9B:
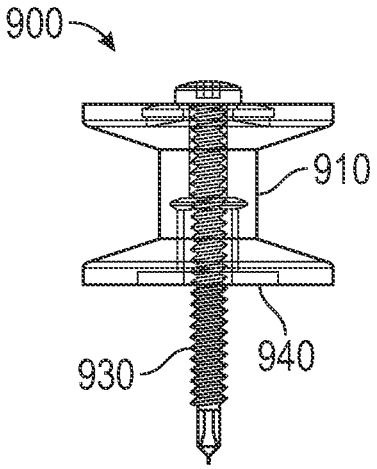
FIG. 9B illustrates a cross-sectional view of a one-piece ice retention spool having a top attachment system, in accordance with various embodiments.

In various embodiments and with reference to FIG. 9A and FIG. 9B, ice retention assembly 900 may comprise a base portion 910 that is configured to receive top portion 920 may be configured to attach or otherwise thread on to base 910. Base portion 910 may also be configured to receive seal 940 on and/or through its bottom surface. Fastener 930 and bonded washer 932 may be installable on and/through top portion 920 and base portion 910 of ice retention assembly 900.

In various embodiments, the ice retention assemblies and spools disclosed herein are installable on a building facade to increase a surface area of the facade and create an engagement point to retain snow and ice. The ice retention assembly may be installed in an array.

After reading the present disclosure, one of ordinary skill will appreciate that the various features described herein may be combined in various ways without departing from the scope of the present disclosure.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B, and C may be present in a single embodiment; for example, A and B, A and C, B and C, or A and B and C.

Systems, methods, and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention claimed is:

1. An ice retention assembly, comprising:

a body having a base portion and a top portion, the top portion being removable from the base portion;

the base portion defining a first portion of a concentric channel that is configured to receive a fastener;

the base portion having a generally planar bottom surface, and a sealing recess defined in the bottom surface that is shaped to receive a seal;

the top portion defining a second portion of the concentric channel;

the top portion having a recess that increases the surface area of a building surface, the top portion sealing the concentric channel in response to being installed onto the base portion;

a seal installable in the sealing recess of the base portion; and a fastener installable through at least the first portion of the concentric channel of the base portion, the fastener configured to compress the base portion and the seal against a surface.

2. The assembly of claim 1, wherein the fastener is threaded into the base portion.

3. The assembly of claim 1, wherein the channel is defined through the base portion and the top portion.

4. The assembly of claim 3, wherein the channel is sized to receive a fastener.

5. The assembly of claim 1, further comprising a two-part washer that is configured to seal the channel.

6. The assembly of claim 1, wherein the sealing recess is shaped to receive an O-ring.

7. The assembly of claim 1, wherein the sealing recess is defined within the base portion and into the channel.

8. The assembly of claim 1, wherein the top portion threads on to the base portion.

9. The assembly of claim 1, wherein the seal is at least one of an O-ring, a stacked cylinder seal, and a tapered seal.

10. The assembly of claim 1, wherein the assembly is installable on a building facade to increase a surface area of the facade and create an engagement point to retain snow and ice.

* * * * *